unleached residue, the leached residue, the leach solution and the gas scrubber solution with the results being as follows in Table 8:

TABLE 8

| | Au | Ag | Pt | Zn |
|---|---|---|---|---|
| Unprocessed ore | .0338[1] | 1.54[1] | .0299[1] | 10.0[2] |
| Wt. in grams | .0000579 | .00264 | .0000512 | 5.00 |
| Wt. in unleached residue | .000232 | .00438 | .000259 | 5.263 |
| Wt. in leach residue | — | — | — | .069 |
| Wt. in leach solution | — | — | — | 5.194 |
| Wt. in scrubber solution | .00252 | .00090 | .000720 | .0099 |
| Total Wt. after processing | .00275 | .00528 | .000979 | 5.27 |
| Equivalent oz per ton of unprocessed sample | 1.61 | 3.08 | .572 | 10.50[2] |
| Ratio of values Processed ore/ Unprocessed ore | 47.50 | 2.00 | 19.12 | 1.05 |

[1] = oz per ton
[2] = percent

EXAMPLE 9

The unprocessed ore for this example was ground to minus 150 mesh. Fifty grams of the ore were placed into a container and intimately admixed with 60 mls. of concentrated HCl and 20 mls. of concentrated $HNO_3$, plus 20 mls. of water. After stirring, the mixture was placed in an oven and baked at 630° C. under quiescent conditions for a period of two hours producing 56.6 grams residue. The fumes coming from the baked sample were scrubbed in 5800 mls. of water containing 50 mls. of concentrated HCl, which was recirculated through a packed tower. The unprocessed ore, the unleached residue and the gas scrubber solution were all analyzed with the results being as follows in Table 9:

TABLE 9

| | Au | Ag | Pt |
|---|---|---|---|
| Unprocessed ore (oz per ton) | .110 | .118 | .028 |
| Wt. in grams | .000188 | .000202 | .0000479 |
| Wt. in unleached residue | .000159 | .0197 | .0000583 |
| Wt. in scrubber solution | .000169 | .000986 | .000116 |
| Total Wt. after processing | .000328 | .0207 | .000174 |
| Equivalent oz per ton of unprocessed ore | .192 | 12.07 | .102 |
| Ratio of values Processed ore/Unprocessed ore | 1.74 | 102.47 | 3.63 |

EXAMPLE 10

A copper oxide silicate iron containing ore which is usually considered to be unprocessable because the copper cannot be leached, floated or otherwise treated, was ground to minus 150 mesh and a 55.6 gram sample was mixed with 90 grams of 98% $H_2SO_4$, 2 grams of NaCl and 20 grams of water. After stirring and baking for two hours at 630° C. under quiescent conditions there was left 66.3 grams of residue in the container. The gases emanating during the baking process were scrubbed with 5300 mls. of water containing 50 mls. of 98% $H_2SO_4$. The scrubbing was done by recirculating the scrubbing solution through a packed tower. The residue obtained was leached in 15 mls. of 98% $H_2SO_4$ diluted with 200 mls. of water. After leaching and drying 44.3 grams of leached resude remained. An analysis was made as recorded in Table 10 below:

TABLE 10

| | |
|---|---|
| Unprocessed ore (percent) | 4.73 |
| Wt. in grams | 2.63 |
| Wt. in leached residue | .0223 |
| Wt. in leach solution | 2.591 |
| Wt. in scrubber solution | .0168 |
| Percent recovered into solution | 99.1 |

EXAMPLE 11

A zinc-silver ore was ground to minus 150 mesh and 95 grams of the ore were mixed with 130 mls. of concentrated HCl, 30 mls. of concentrated $HNO_3$ and 10 mls. of water. The mixture was stirred well and placed in an oven at ambient temperatures which was heated to 700° C. and maintained at that temperature for 2 hours. The fumes from the baking process were scrubbed in 7800 mls. of a dilute HCl acid scrubbing solution which was recirculated through a packed tower. After baking, a residue comprising 122.0 grams was leached with 190 mls. of a solution comprising 150 mls. of water, 30 mls. of concentrated HCl acid and 10 mls. of concentrated $HNO_3$. The leached residue was dried and weighed at 75.6 grams. The raw ore, leached residue, leached solution and gas solution were all analyzed with the results being reported as follows in Table 11:

TABLE 11

| | Au | Ag | Pt | Cu | Zn |
|---|---|---|---|---|---|
| Unprocessed ore | .0413[1] | 50.76[1] | .0506[1] | .380[2] | 5.00[2] |
| Wt. in grams | .000134 | .165 | .000165 | .361 | 4.75 |
| Wt. in unleached residue | .000186 | .168 | .000282 | — | — |
| Wt. in leached residue | .000186 | .168 | .000282 | .0101 | .0561 |
| Wt. in leach solution | — | — | — | .364 | 2.73 |
| Wt. in scrubber solution | .00156 | .00156 | .000780 | .0172 | 2.293 |
| Total Wt. after processing | .00175 | .170 | .00106 | .391 | 5.08 |
| Equivalent oz per ton of unprocessed ore | .539[1] | 52.28[1] | .325[1] | .391[2] | 5.10[2] |
| Ratio of Values Processed ore/ Unprocessed ore | 13.06 | 1.03 | 6.42 | 1.03 | 1.02 |
| % of Cu and Zn in Solution | — | — | — | 97.2% | 98.8% |

[1] = oz per ton
[2] = percent

EXAMPLE 12

An antimony containing ore was ground to minus 150 mesh. A 50 gram sample of the ore was mixed with 100 mls. of concentrated HCL, 5 mls. of concentrated $HNO_3$ and 10 mls. of water, and thoroughly mixed for 1½ hours and placed in a furnace preheated to a temperature of 300° C; within 45 minutes the temperature had reached 630° C. and the mixture was baked at 630° for one and one-half hours under quiescent conditions and then removed from the furnace. The gases emanat-

PROCESS FOR RECOVERY OF ZINC VALUES FROM ZINC WASTE

When zinc is used for various purposes, for example, zinc coating for corrosion protection, a flux containing chlorine will be used. By these methods a chlorine-containing waste in the form of zinc ash occurs which is skimmed off.

The waste material usually contains also a certain amount of zinc metal. By use of a known technique, however, the metallic part of the waste can be separated from the zinc ash to the extent which is practical for the further treatment of the zinc waste.

The waste product is usually so much contaminated by chlorine that it cannot, for example, be included directly into the conventional hydrometallurgic/electrowinning production of zinc from a sulphate solution subsequent to dissolution in sulphuric acid. In accordance with the prior art, therefore, the chlorine-containing waste has been mainly used in thermic processes.

From Norwegian patent No. 126,852 a process is known for treating chlorine-containing zinc waste in order to use it as a raw material in the production of zinc from zinc sulphate solutions. The process according to the said patent is based on a dissolution of the zinc values by leaching the waste material in sulphuric acid followed by a purification process removing chlorine from the chlorine-containing zinc sulphate solution formed thereby by a liquid/liquid extraction process.

The invention relates to a process for recovering zinc and other metal values from zinc ash or other metal waste materials containing chlorine and/or other halogens and other anions which form undesirable metal salts, for example, nitrates and phosphates, the process being characterized in that the metal waste is leached with a liquid organic phase containing a cation exchanger, for example a carboxylic acid such as "Versatic 911" or an alkyl phosphoric acid such as di(2-ethylhexyl) phosphoric acid (DEHPA), whereby a metal organic complex is formed which is soluble in the organic phase, and in that halogens and other impurities in the organic phase are removed by washing the organic phase with water or with an aqueous alkaline solution, whereafter the organic phase is brought into contact with a mineral acid, zinc and other metals being thereby extracted into the aqueous phase forming a pure metal salts or a pure metal salt solution, from which the zinc can be recovered by known methods.

The advantage of the invention in relation to previously known methods resides in the simple and effective way by which the chlorine is kept away from the zinc sulphate solution.

According to the present invention, a process is provided which is based on a direct treatment of the chorine-containing zinc waste with an organic phase consisting of a liquid cation exchanger of the type which generally can be used for separation and recovery of metal ions from aqueous metal salt solutions by liquid/-liquid extraction. Examples of these kinds of cation exchangers will be fatty acids, napthenic acids and other carboxylic acids, such as the commercial type called Versatic 911 (Shell) or an alkyl phosphoric acid such as di(2-ethylhexyl) phosphoric acid (DEHPA). The organic cation exchangers should preferably be in the acid form dissolved in a suitable organic solvent which has a low solubility in an aqueous phase.

The zinc oxide in the chlorine-containing zinc waste material will react directly with the organic acid (cation exchanger) forming a metal organic complex which is soluble in the organic phase.

During the reaction, the chlorine present in the waste material may be included in the complex formation, for example, in the form of hydrochloric acid or other chlorine compounds, thereby being dissolved in the organic phase. By a subsequent contacting between the organic phase and an aqueous phase, optionally with the presence of an alkali, for example, sodium hydroxide, any chlorine compounds in the organic phase will be washed out. After the washing with a neutral or an alkaline aqueous phase the organic phase will be free from chlorine and containing only the metal organic complex.

By a subsequent contacting of the organic phase with sulphuric acid, the metal is stripped into the aqueous phase forming a zinc sulphate solution which is suitable for the conventional hydrometallurgic/electrowinning production of zinc. It is also possible to precipitate the zinc sulphate directly from the said solution, if this is suitable.

The organic cation exchanger, after contacting with the sulphuric acid, will be in the acid form and is returned to the process for the reaction with the chlorine-containing zinc waste material.

The present invention is not restricted to zinc waste alone, but can be utilized in general for the recovery of metal values such as copper and nickel from metal-containing waste materials by the described reaction between the metal compounds and an organic leaching liquid such as one of the described types of cation exchangers. The advantage of this process over a direct solution of metal values in conventional inorganic acids, is that it is possible in an effective and simple way of washing the metal loaded organic phase with an aqueous phase to avoid undesirable anions such as chloride, bromide, fluoride etc., in the resulting metal salt solution. The following example illustrates the invention.

EXAMPLE

Technical zinc waste (zinc ash) produced as melting loss in thermal zinc coating, was treated by mechanical screening to remove the main part of the zinc metal present. The further experiments refer to the screened material.

The zinc waste was firstly subjected to an examination by dissolution in strong sulphuric acid. This yielded an insoluble residue which was not further examined, but which can be characterized as a sand-like material. The zinc waste contained 3% of this insoluble material.

Further analysis of the zinc waste showed a content of 80% zinc and 2.7% chloride.

The preliminary mechanical screening resulted in a fraction of finely divided metallic zinc still present in the zinc waste. The said zinc metal fraction was about 30% of the waste. The remaining amount of zinc (about 50%) will consist mainly of oxides, chlorides and oxychlorides.

100 g zinc waste was contacted with one liter of organic phase consisting of 30% Versatic 911 dissolved in "Shellsol TD". After stirring for 50 minutes at 50°C the solid and the liquid phase was separated. 66 g of the zinc waste had been dissolved by the organic phase. The organic phase was analysed, showing a content of